US006511383B1

(12) United States Patent
Raidt et al.

(10) Patent No.: US 6,511,383 B1
(45) Date of Patent: Jan. 28, 2003

(54) MULTI-BAY BUNGEE-CORD ACROBATIC SUSPENSION & TRAMPOLINE STRUCTURE

(75) Inventors: Alexander Raidt, San Diego, CA (US); Peter C. Raidt, Rottenburg (DE)

(73) Assignee: Leisure Inventions Company (KY)

( * ) Notice: Subject to any disclaimer, the term of this patent is extended or adjusted under 35 U.S.C. 154(b) by 0 days.

(21) Appl. No.: 09/679,674

(22) Filed: Oct. 4, 2000

Related U.S. Application Data

(60) Provisional application No. 60/157,886, filed on Oct. 5, 1999.

(51) Int. Cl.[7] ..... A63G 13/00

(52) U.S. Cl. ..... 472/135; 472/133; 482/23; 482/124

(58) Field of Search ..... 472/133, 135, 472/14, 42; 482/23, 26, 27, 28, 30, 29, 124

(56) References Cited

U.S. PATENT DOCUMENTS

| | | | | |
|---|---|---|---|---|
| 2,221,215 A | | 11/1940 | Eyerly | 272/6 |
| 3,006,645 A | | 10/1961 | Frazier | 272/60 |
| 5,094,448 A | | 3/1992 | Hackett | 272/93 |
| 5,203,744 A | | 4/1993 | Checketts | 472/131 |
| 5,221,241 A | | 6/1993 | Bare | 482/27 |
| 5,267,906 A | | 12/1993 | Kitchen | 472/118 |
| 5,421,783 A | | 6/1995 | Kockelman | 472/135 |
| 5,527,223 A | | 6/1996 | Kitchen | 472/118 |
| 5,593,368 A | * | 1/1997 | Checketts | 482/27 |
| 5,649,866 A | | 7/1997 | Balwanz | 472/118 |
| 5,788,606 A | * | 8/1998 | Rich | 482/27 |
| 5,810,672 A | | 9/1998 | Balwanz | 472/118 |
| 5,816,983 A | | 10/1998 | Dawes | 482/78 |

FOREIGN PATENT DOCUMENTS

| | | | |
|---|---|---|---|
| DE | 4335452 | 4/1995 | A63B/5/16 |
| DE | 9317279 | 10/1995 | A63B/5/16 |

* cited by examiner

*Primary Examiner*—Kien T. Nguyen
(74) *Attorney, Agent, or Firm*—Birch, Stewart, Kolasch & Birch, LLP

(57) ABSTRACT

A geometric-tree like gymnastic amusement-thrill structure, devised for relatively safe, exhilarating, gravity defying, action by several novice or skilled aerobatic gymnasts at one time; each enjoying their own bungee-cord suspension. Efficiently based upon a central ground-anchored vertical trunk-pylon member employing a preferably four-way arrangement of radially upward and outwardly extending branch support-booms, each in discreet combination with a laterally supporting ground-anchored beam extending upward to a point proximal the base of its respective support-booms. Plus, nearly vertical compression-load beams are secured at their lower-ends near each support-boom's lower treminus, and secured at their upper-ends near the outer ends of the respective overhanging support-boom. This X-shaped structure is additionally secured in rigid stance via a plurality of strategical placed triangulated tension-cables extending upward at an angle from proximal the ground anchoring point of the lateral ground-anchored beams to a point well up on the support-booms. The structure is preferably of aluminum or steel tubing, and separate bungee-cords are strung between the outer distal ends of each support-boom, and each bungee-cord control-cord rides over a separate polly to extend down to the ground for winch-drawn anchoring. A trampoline is arranged directly below each of the four exemplified bungee-cord aerobatic maneuvering-bays located between the respective support-booms, thereby providing a cooperative elastomeric platform compelling greater imputus to one's gymnastic gyrations.

26 Claims, 2 Drawing Sheets

MULTI-BAY BUNGEE-CORD ACROBATIC SUSPENSION & TRAMPOLINE STRUCTURE

This application claims benefit of Provisional Application Serial No. 60/157,886, filed Oct. 5, 1999.

BACKGROUND OF THE INVENTION

1. Field of Invention

This invention relates to gymnast anti-gravity bungee-cord suspension apparatus, and more specifically it relates to those types of apparatus employing a specialized ground-anchored structure for supporting a plurality of gymnasts.

2. Relevant Prior-Art

Background research discovery provides some prior patent-art regarded as germane to this disclosure, chronologically for example U.S. Pat. No. 2.221,215(filed: February 1938 ) shows an amusement apparatus employing a central tubular-pylon which serves both as a tall elevator like structure, and as an attractive housing within which a pair of independent polly-cables are routed upward from a motor-driven cable-winch. An operator at the base of the pylon acts to release a catch, thereby suddenly catapulting a paying-rider seated in a catapult-chair vertically via energy stored in a bungy-cord cluster owing to a pretensiohing by the cable-winch. However;--the rider is not free to enjoy a true feeling of anti-gravity floating effect, in as much as the catapult-chair reaches its apogee then vertically oscillates a few times until the initial energy is expended and the rider reaches their equilibrium, then must be lowered to the ground by the operator.

In U.S. Pat. No. 3,006,645(filed: May 1959) is shown a specially configured gimbal like waist-belt apparatus having a series of bungee-cord restraints-anchored to a large annulas having two horizontally opposed pivot-axes each moored to a clevis-joint and a rope strung upwards to a crossbeam in support of the rider. The purpose of the apparatus is an acrobatic training-aid, enabling the user to become hoisted up from the ground-level to a height where they can engage in various disorienting gyrations; as to thereby become more comfortable with the twisting forces attendant to aerial-acrobatics.

In U.S. Pat. No. 5,094,448(filed: January 1990 from France) is shown an improved bungee-cord jumping-rig for jumping-off from a platform such as a bridge or other special structure; and involves a complex arrangement of pulleys and ropes by which to adjust the length of the bungee-cord to match the pretested weight of the rider, so as to assure their not impinging upon the ground below (in as much as a rider of greater weight bill necessarily impose a greater force of inertia, thereby tending to stretch the bungee-cord dangerously close to the ground or river-bed. However, the apparatus is for extraordinarily great jumping heights, and does not contemplate the possibility of interplay with a secondary platform near the ground-level for added inertial gyration activity.

In U.S. Pat. No. 5,203,744(filed: August 1991) is shown a T-shaped tower structure having a spiral-staircase winding (or optional escalator not shown) up its central pylon portion whereby rider participants venture high to the uppermost horizontal bridge-like cantilevering structure, where they are secured into a body-harness (comprising both chest and pelvic webbing) connected to a special resilient cylindrical-bag to which the bungee-cord is directly secured, and thereby proceed to leap from the bridge platform in an exhilarating free-fall rate downward toward an commercial safety-airbag provided as a back-up in the event of a suspension-cord failure. The presence of the resilient-cylinder is said to somewhat dampen the heretofore sudden jerk of the bungee-cord, while also lessening the possibility of the suspension-cord abrading against or otherwise strangling the neck of the rider; in as much as the rider appears to be secured dependent upon the resilient-cylinder (not clearly revealed). in U.S. Pat. No. 5,221,241(filed: January 1992) is shown a gymnastic training apparatus for trampolinists, balance-beamists, and free-style skiers, etc.; and features an arrangement of bungy-cord elements secured centrally to a gymnast person wearing a so called Pond type training-belt (waist & pelvic-harness) supporting two horizontally opposed pivot-axes. Once donning the supporting belt-rig, an assistant winches the gymnast well above the floor-level via a pair of pulley-cables coupled to a windless-winch, whereby the gymnast can then deploy themselves into various attitudes of seemingly gravity-free: gyrations. However, there is no provision for a light-weight free-standing suspending structure, nor for interplay with a near floor-level elastomeric inertia enhancing device.

In U.S. Pat No. 5,267,906(filed: August 1992) & 5,527,223(filed: June 1994) is shown a pair of opposed triangulated-steel tower structures, which are formed in a unique obliquely inclined opposition toward one another, (the later iteration reveals a more elaborate inverted U-shaped structure opposing a narrow X-shaped jumping tower), thereby affording a more generous area of activity clearance there between their rigid structures, for non-bungee rope-swinging activity. The notion here is to afford the rider certain sensations of bungee-jumping, yet in a more free-flying like modality of activity.

In U.S. Pat. No. 5,421,783(filed: July 1993) is shown a so called human-slingshot machine, which entails a pair of vertically opposed stanchions which can be assembled in convenient shorter segments whereto the assembled upper terminuses each include a guide-pulley over which is winch drawn a pair of pull-cables which together pre-tension a pair of bungee-cord clusters. Once sufficiently pre-tensioned, a mooring-latch situated at the base of the rider's catapult-seat is released, enabling the opposed tensioned bungee-cords to instantly fling the occupant vertically, where the person oscillates for a few moments until their inertia has become finally dissipated. Again, it sets forth a single-occupant station structure, wherein there is no provision for further interplay with a near ground 5 level elastomeric inducing device.

In U.S. Pat. No. 5,649,866(filed: March 1996) is shown another amusement-thrill apparatus comprising a triad of tall spaced apart vertical-tower structures, the first tower employing an internal vertical lift-cable taking a catapult-chair (with occupant) to the top of the first tower, whilst simultaneously a bungee-cord cluster is being pre-tensioned via servo winches operating from within the broadly opposed second and third suspension-towers. Thus upon release of the holding-latch, the catapult-chair is flung forward in a downward swinging arc, owing to pull of gravity, resulting in very rapid acceleration passing between the two suspension-towers, then gyrating to-and-fro until the inertia has dissipated, whereupon the catapult-chair is lowered to the ground to accommodate the next rider(s). Similarly, in the inventors' subsequent U.S. Pat. No. 5,810,671 (filed: August 1997) is shown a variant arrangement of only two suspension towers, operating in combination with an initial relatively lower guide-track structure which positions the catapult-chair back from the two towers in the desired pre-launch position.

In U.S. Pat. No. 5,816,983(filed: March 1997) is shown a smaller-scale aerobic bouncing and stretching exercisingchair, including a steel-pipe supporting-structure on three sides (left, back, & right sides) leaving an open ingress-egress frontal-side; and is particularly intended for handicapped, disabled, and infirm persons, normally lacking in adequate aerobic-exercise dynamics. The user is suspended in the dynamic-seat, with the ability to grip the upper/side-structure as to induce bouncing and swinging gyrations.

Finally, in German Pat's. No. DE-4335452-A1(filed: October 1993) & No. DE-9,317,279-U1(filed: November 1993) by the co-inventor's hereof, is shown a "bungee-cord (rope) over stretching protection device", which serves various sorts of bungee-cord applications.

Therefore, in full consideration of the preceding patent review, there is determined a need for an improved form of device to which these patents have been largely addressed. The instant inventor hereof believes their newly improved amusement-thrill apparatus, commercially referred to as the Multibay EUROBUNGY-TRAMPOLINE™, currently being developed for production under auspices of the EuroBungee-Mfg./Mkt.Co. (www.eurobungy.com), exhibits certain advantages as shall be revealed in the subsequent portion of this instant disclosure.

SUMMARY OF THE INVENTION

A.) In view of the foregoing discussion about the earlier invention art, it is therefore important to make it pellucid to others interested in the art that the object of this invention is to provide a multi-bay amusement-thrill structural apparatus for aerially suspending novice or skilled acrobat participants in spatially segregated dynamic maneuvers. The multi-bays, generally referred to as maneuvering-bays, are well defined by the particular structural spider configuration; for example our presently most, preferred embodiment is a four-bay design, which is comprised of a vertical central pylon providing a common intersection mooring for a plurality of four rigid contiguous tubular support-booms (preferably made of metal such as aluminum or steel, but can be fabricated of a fiberglass-impregnated polymer material). These support-booms obliquely bisect,:the pylon approximately midway up the pylon (some iterations at proximally the top of the pylon), whereby each support-boom is thereby impinging down upon the grounding-surface at its lower half leg portion, while its opposite upper half arm portion extends up in the air away from the central pylon. Most iterations of the invention structure thus find any two oppositely opposing support-booms thus forming an X-shape as viewed in side/elevation-view; and wherein it is also preferred that each support-boom be comprised of two half-sections which when joined to the center pylon appear as a single long support-boom. In general terms of physical size scale, our most popular model employs support-boom half-portions which are about 6-meters long, thereby providing an overall grounding foot-print of about 10-meters (measured between the 180-degree opposing X-shaped leg impingement points standing operationally upon the ground). However, the invention can actually be made much larger if desired, and can be configured with as few as three maneuvering-bays or even eight maneuvering-bays in larger scale iterations.

A plurality of compression-beams (preferably of tubular metal, such as steel or aluminum) are preferably also included, in as much as they materially aid the structural-rigidity of the overall structure, especially when it is utilized as a semi-portable free-rigidity standing unit. The compression-beams each extend approximately vertically between the lower leg portion of a given support-beam, and upwardly to the overhanging upper arm portion of a bisecting opposite support-boom member; thereby in aggregate totaling four compression-beams in the example of a four-bay four support-boom configured structure.

Our aerial suspension structure is preferably also made further rigid via a cooperative plurality of tension-cables (preferably of multi-stranded, hence flexile metal or polymer material) coordinated in a triangulating arrangement, and secured via mechanical attachments to the respective distal ends of the central pylon and the support-booms; thereby creating a rigidly united free-standing (whereby the lower leg portions of the support-booms do not have to be permanently buried into the ground or concrete) structure. Hence, the structure can if preferred be made semi-portable, simply by loosening the tension-cables and either pivotally folding or detatching the individual support-boom members.

B.) Another object of this invention disclosure is to set forth an amusement-thrill article according to preceding item-A, wherein is also provided a resilient-platform in the form of a conventional trampoline-platform or a conventional inflated airbag: type of platform, either of which enabling the acrobatic person to enjoy further inertial impetus as is compelled by the acrobat generally intentionally rebounding thereupon. Additionally, the trampoline or airbag afford the performer the added confidence that a soft-landing area is there below as a precautionary safety provision. In our four-bay (maneuvering-bay) structural configuration for example, two of the maneuvering-bays may employ the more "springy" trampoline-platform, while the third maneuvering-bay may employ an; airbag-platform, while the third maneuvering-bay may employ only at ground-level perhaps 10-inches of sand, foam-rubber, or even a cushioning water-pool for example (the entire structure can be situated over an existing home, hotel, or Sea-World type of swimming-pool if desired). However most advantageously, both the trampoline d airbag apparatus are known to be readily adjustable for varying degrees of impact compliance, as compared to the other mentioned alternatives (and a safety-net is cumbersome relative to entanglement).

C.) Another object of this invention disclosure is to set forth an amusement-thrill article according to preceding items-A&B, wherein is also provided an arrangement of preferably discrete (one for each acrobatic maneuvering-bay) pulley-lines which are preferably separately anchored at the base of the central-pylon and extend upward over a guide-pulley moored proximally the upper distal terminus of the respective support-boom arm portions. In this manner, with the suspension-spring medium (preferably comprising a plurality of bungee-cord elements) securely coupled to the pulley-line, the acrobat person can be hoisted well upward from the embarking-surface (ground or trampoline for example). The pulley-line is generally deployed from a conventional manual windlass (winch) device fixed at the base of the central-pylon; or, can be deployed, that is shortened to raise/elevate the acrobat secured to the bungee-cord suspension me dim, or the pulley-line lengthened to lower the acrobat person back to the embarking-surface when time for their exercising-routine performance is concluded.

The winching device can more preferably be motor (preferably electric) operated via a conventional bidirectional (reversible-drive) powered winch device (commercially available), whereby the acrobat is thus selectively actuated (raised/lowered). via the pulley-line by a conventional double-pole/double-throw momentary (of the type automatically biased or spring-nulled to center-off open-circuit position) control-switch.

Moreover, it is further preferred that the switching-circuit include a remote-slave RF(radio-frequency)-receiver module, whereby the acrobat or ground-operator be provided by with (carried with them) a remote-control command-module; thereby enabling remote regulation of the degree of tension being applied to the pulley-line according :to their (acrobat or ground-operator/instructor-trainer) personal preference (and as to the weight and dexterousness of the acrobat).

The primary suspending bungee-cord is preferably a multi-stranded flexile linear unit (although a less desirable metal/tension-spring(s) may be alternatively employed or combined), and is preferably strung in one-piece across the maneuvering-bay between the upper terminuses of two adjoining support-booms. Hand-grips (such as hand-grip rings) are thus securely attached to the bungee-cord medium in a manner whereby the laterally out-reaching arms of the acrobat can readily grip the two hand-grips, with the linear body of the bungee-cord extending optionally horizontally across in front of, or horizontally across behind the acrobat's body. An alternate arrangement is to employ the bungee-cord in two cooperative albeit separate linear sections, one portion from each of the said adjoining support-booms; however, this arrangement does not enable the acrobat to enjoy leaning upon and twirling around the suspending medium, but rather the acrobat's arms themselves serving as contiguous portions of the suspension-line (bungee-cord.) medium.

Additionally, it is generally preferred (except in the case of daring professional acrobatic acts, or if staged above a body of water (where a gyrating person may release from the suspension-line just for the fun of plunging into the water) that the acrobat be actually positively secured to the suspension-spring (usually bungee-cord) suspension-line via a conventional abdominal or pelvic safety-harness device capable of passively holding the acrobat fast to the bungee-cord without hand assistance.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

ITEMIZED NOMENCLATURE REFERENCES

10,10'—exemplified overall gymnastic supporting structure, maneuvering-bay
11'/11"—1st support-boom (lower leg portion/upper arm portion)
12'/12"—2nd support-boom (lower leg portion/upper arm portion)
13'/13"—3rd support-boom (lower leg portion/upper arm portion)
14'/14"—4th support-boom (lower leg portion/upper arm portion)
15,15'15"—central-pylon, optional height (phantom outline), vertical-axis,
16,16'/16"—1st compression-beam, attachment-clevis (upper/lower)
17,17'/17"—2nd compression-beam, attachment-clevis (upper/lower)
18—3rd compression-beam
19—4th compression-beam
20'/20"—conventional resilient-platform (trampoline/airbag)
21'/21"—acrobat (normal-orientation/intentionally-inverted)
22'/22"—jouncing-action ref.-arrows (downward/upward)
23,23'/23"—suspension-spring medium (clustered bungee-cord), relaxed/tensioned
24—reversible windlass winch
25—pulley-line (nylon rope)
2'6/26"—guide-pulley (lower/upper)
27—conventional abdominal/pelvic harness
28'/28"—hand-grips (left/right)
29—continuous portion of suspension-spring medium
30—optional sandpit or water-pond
31—rigid support-strut (optional at each support-boom leg intersection)
32—lower terminus fitted with impingement-pad
33'/33"—tension-cables (lower/upper)
34'/34"—RF-transmitter (command-module), RF-receiver
35—six-pointed cross structure configuration, hexagonal stringing of bungee-cord
36—three-pointed cross structure config., triangular stringing of bungee-cord
37—eight-pointed cross structure config., octagonal stringing of bungee-cord
38,38'—embarking or ground-surface, ground-plane footprint area delineation
39—stringing-pattern of suspension-medium (aerially viewed)

40,40',40"—vertical ref.-line, horizontal ref.-line, horiz. transverse ref.-line

41'/41"—mooring-junction clevis-joints (upper/lower)

V.) DETAILED DESCRIPTION OF THE PREFERRED EMBODIMENTS

Figure 1:
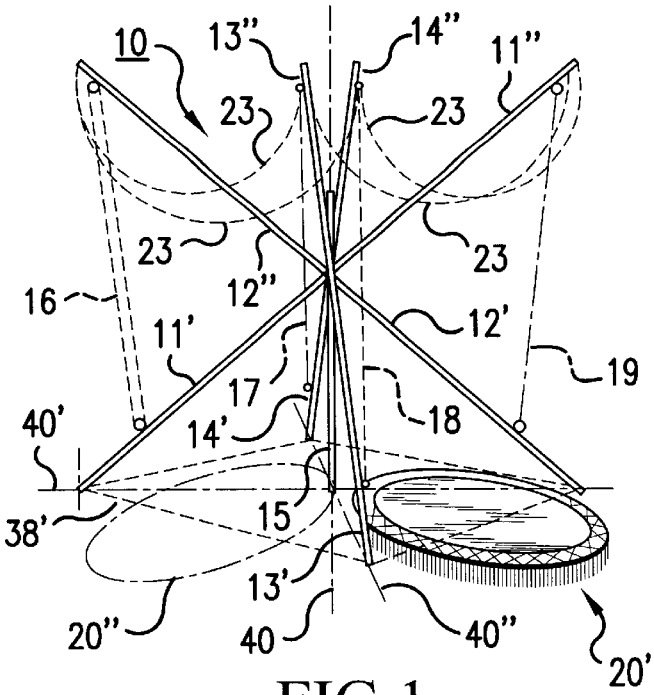
FIG. 1, is a semi-diagrammatic pictorial perspective-view of our overall invention, this viewing aspect favoring the frontal upper-left portion of the somewhat spider like structure, wherein certain portions are shown via phantom-outlining for greater visual clarity.

Initial reference is given by way of FIG. 1, wherein is exhibited the overall minimal supporting structure 10, here comprised essentially of four contiguous support-boom members 11'/11", 12'/12", 13'/13", and 14'/14", which are medially anchored into a central-pylon member 15. Note here also that while the support-booms could be made in one-piece, it is preferred that each support-boom be made in two-pieces (ie- 11'and 11") as to facilitate easier handling; thus also providing the option of a foldably collapsible structure. In practice, we have also found that the inclusion of a individually dedicated compression-beams phantom-indicated at exemplified outline 16, the three others being simply positionally indicated via ref.-lines 17, 18, 19, for sake of visual clarity. Note also the exemplifying draped (relaxed) presence of four separate suspension-spring members 23'. Also note in FIG.-1 that the preferred inclusion of structural tension-cables have been obviated for sake of visual clarity (see FIGS.-2,3,5).

The ground-plane foot-print area overshadowed by the structure is phantom indicated via ref.-line 39', which is tantamount to that aerial stringing-pattern defined by the suspension-medium (bungee-cord) 39; while the horizontal ref.-line is indicated at 40' and the transverse ref.-line thereto is at 40", while the central vertical ref.-line is indicated at 40'. The resilient-platform 20' included in FIG.-1 is a preferred commercially available trampoline, however the left adjacent maneuvering-bay space shows an area se outline exemplifying the option of a commercially available airbag 20". Looking at FIG.-2 we see a birds-eye view wherein trampolines 20' are represented in two of the maneuvering-bays, while a third bay shows an airbag 20", and the forth bay suggests some alternative such as a sandpit. However, one can readily see how the entire suspension structure can even be staged over a swimming-pool if desired; thereby obviating need for any other soft-landing contrivance; although with the four lower support-boom leg terminuses impinging upon the upper-outer margins of to swimming-pool surround, the practical water-hovering maneuvering-bays essentially become the two bays shown here occupied by the trampolines 20'(thus nothing would then be located in the remaining two other bays).

Figure 2:
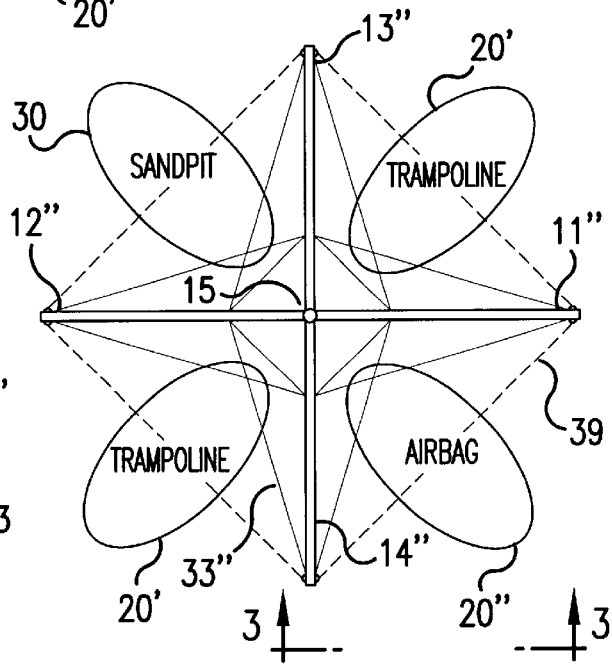
FIG. 2, is a semi-diagrammatic upper/plan-view thereof, wherein is also revealed the preferred relative placement of the resilient-platform members.
Figure 3:
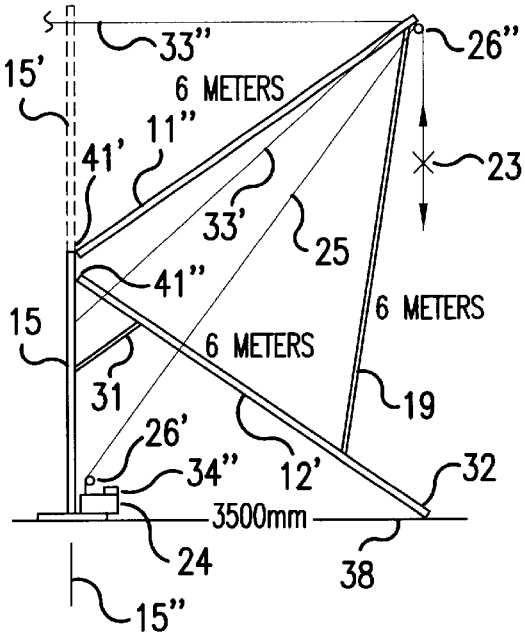
FIG. 3, is a semi-diagrammatic quarter side/elevation-view projected along plane 3:3 in FIG. 2, and also reveals the preferred modular construction of the three assembled structural members.

There remain subtle, however vital other differences which are to become herein more evident and understood as important improvements. For example, FIGS.-2&3 show how the preferably included tension-cables 33' and 33" are arranged in a triangulating manner (much like the taught rigging stabilizing a sailboat's mast for example), which can be varied somewhat from that suggested here (according to manufacturing design preference). Note also in FIG.-3 that the central-pylon 15 having vertical-axis 15" is shown abbreviated in vertical length; however, this is a minimal length of reference, and if desired can be of a 6-meter modular length or actually even extend upward to a point even above that indicated at 15' to further enhance effectiveness of upwardtensioning of so the tension-cables 33" relative to the outer distal arm ends of the support-booms.

Also in FIG.-3 is shown the preferred arrangement by which the exemplified winch 24 can be positioned below the inboard mooring point of the exemplified support-boom arm 11", while the thus reeled pulley-line (generally nylon cable or quality rope) 25 riding over lower guide-pulley 26' is obliquely directed to ride over upper guide-pulley 26" which is preferably gimballed (not detailed in drawings) for free orientation relative to the transverse stringing and up/down oscillations of the suspension-medium 23.

Figure 4:
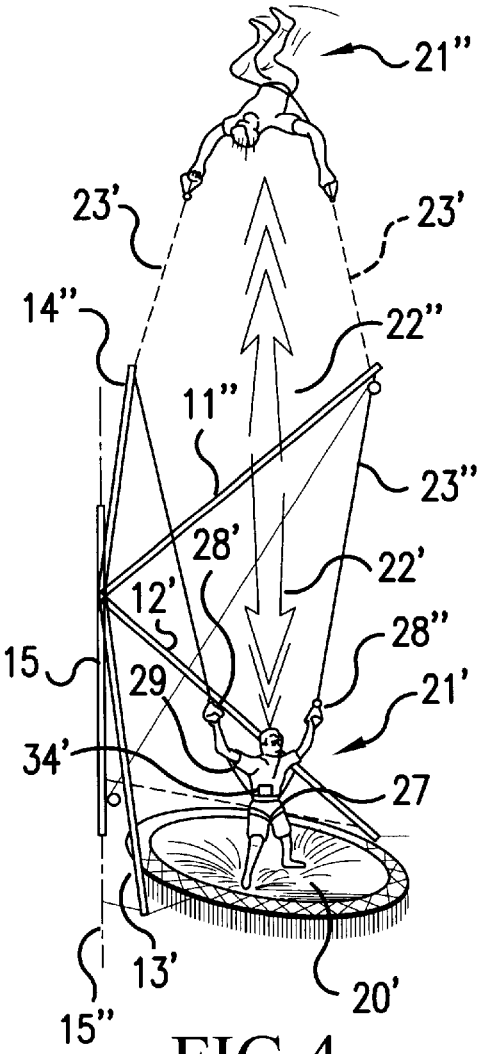
FIG. 4, is a fragmented viewing-aspect replicating only that portion of FIG. 1 posed between the two upper-right arm portions and two lower-right leg portions of the support-booms, and demonstrating how the interplay of rebounding from the trampoline can provide greater acrobatic gyrational dynamics (note: -presence of tension-cables of FIGS. 2&3 is eliminated for sake of visual clarity)

Reference to FIG.-4 shows the acrobat 21' staged upon a substantially conventional resilient-platform 20' (here a conventional trampoline, but could be an airbag), the acrobat being either in the ready position for hoisting up about 6-meters via the winch in FIG.-3, or already in the process of dynamically gyrating (according to dynamic inertial action ref.-arrows 22' and 22") and in some moments even (optionally according to increasing skill and confidence of the acrobat) enjoying inversion rebounding from interacting upon resilient-platform 20' as is suggested in FIG.-21". Notice also in FIG.-4 where the acrobatic person 21' is shown optionally equipped with a conveniently accessible Velcro® attached battery-powered command-module in the form of a tiny RF-transmitter, 34' which when pushbutton activated sends a signal to a cooperative RF-receiver 34" preferably located immediately with the winching unit 24 (in FIG.-3). This novel remote-control system utilizes commercially available (ie- RadioShack®/Tandy-Corp.) hardward, and advantageously enables the performer (or their ground situated instructor) to regulate deployment of the pulley-line according to the particular weight and physical dexterity of the performer.

Figure 6:
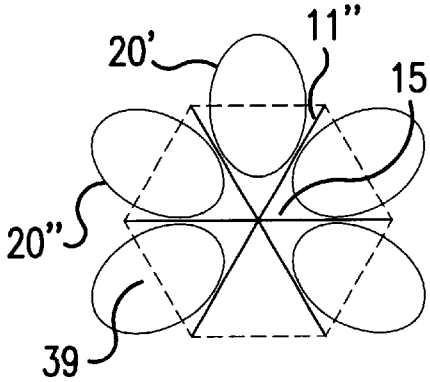
FIG. 6, is a semi-diagrammatic upper/plan-view of reduced scale representing a 6-bay iteration hereof, wherein is also revealed the preferred relative placement of the resilient-platform members.
Figure 7:
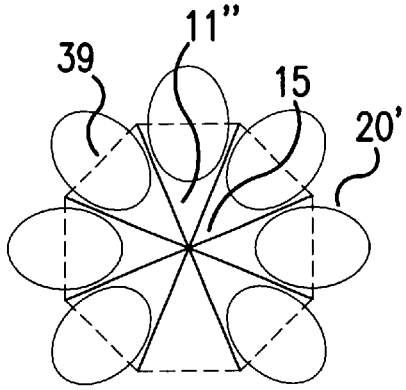
FIG. 7, is a semi-diagrammatic upper/plan-view of reduced scale representing an 8-bay iteration hereof, wherein is also revealed the preferred relative placement of the resilient-platform members.
Figure 5:
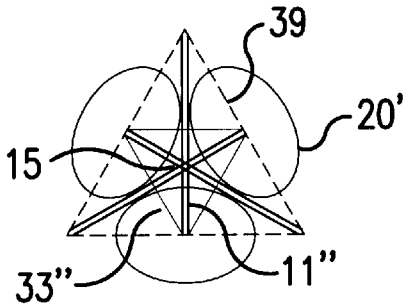
FIG. 5, is a semi-diagrammatic upper/plan-view of reduced scale representing a 3-bay iteration hereof, wherein is also revealed the preferred relative placement of the resilient-platform members.

The upper/plan-view studies of FIGS.-5,6,7(not shown in actual dimensional scale to one another), serve to reveal other possible generic-variant iterations of our suspension structure; wherein FIG.-5 shows a triad or delta shaped tripple support-boom configuration having upper triangulated tension-cables 33", which layout employs only three distinct maneuvering-bays 10'. In FIG.-6 is set forth a necessarily larger six-bay configuration distinguished by the hexagonal stringing-pattern of its suspension-medium; while lastly, in FIG.-8 is set forth our largest embodiment employing eight independent maneuvering-bays 10', wherein the suspension-medium stringing-pattern defines an octagonal configuration.

Thus, it is readily understood how the preferred and generic-variant embodiments of this invention contemplate performing functions in a novel way not heretofore available nor realized. It is implicit that the utility of the foregoing adaptations of this invention are not_ necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A four-bay amusement-thrill apparatus for aerially suspending four separate participants in spatially segregated dynamic maneuvers; said apparatus comprising:

a rigid central vertical pylon providing a common intersection mooring means upholding a plurality of four rigid contiguous tubular support-booms obliquely bisecting midway up said pylon, whereby each of said support-booms is thereby impinging down upon the grounding-surface at its lower half leg portion while extending up in the air via its opposite upper half arm portion relative to said pylon;

a cooperative plurality of tension-cables arranged by triangulating means and secured via mechanical attachment means proximal the upper distal ends of said pylon and said support-booms, said triangulating means thereby creating a rigidly united free-standing structure of said obliquely angled support-booms;

a discrete arrangement of suspension-spring medium means strung between the distal terminuses of said support-booms, thereby defining spatially distinct naneuvering-bays within which acrobatic persons can independently exercise bodily gyrations at will while suspended in the air from tension-spring means arranged proximally between any adjoining said support-booms.

2. The amusement-thrill apparatus according to claim-1, wherein is also included dedicated compression-beams, one extending approximately vertically between said lower leg portion of a said support-boom and upwardly to an overhanging upper arm portion of a bisecting opposite said support-boom; thereby totaling four said compression-beams in aggregate contributing additional rigidity to the overall said structure.

3. The amusement-thrill apparatus according to claim-1, wherein cooperative pair of said suspension-spring medium means provided with a maneuvering-bay are each secured to a separate pulley-line means moored from a guide-polly secured proximally the outer-upper distal end of a proximal said support-boom arm portion, thereby enabling the addressing acrobatic person to be independently raised from an embarking-surface when said pulley-line is shortened and conversely lowered to said embarking-surface when said pulley-line is lengthened.

4. The amusement-thrill apparatus according to claim 3, wherein said pulley-line means is shortened or lengthened via advantage of a motor-driven windlass racheted winch having reversible-drive means.

5. The amusement-thrill apparatus according to claim 4, wherein said motor-driven reversible-drive is activated via a remote-controlcommand-module carried upon the acrobatic person or ground-operator; thereby enabling remote regulation of the degree of tension applied to the said pulley-line according to their personal preference.

6. The amusement-thrill apparatus according to claim 3, wherein said pulley-line means is shortened or lengthened, via advantage of a manual racheted winch.

7. The amusement-thrill apparatus according to claim-1, wherein said suspension-spring medium means is essentially of one section continuous construction, and comprised of one or more linearly clustered conventional bungee-cord elements.

8. The amusement-thrill apparatus according to claim-7, wherein said one section bungee-cord member includes a proximally medially located acrobat holding means in the form of a pair of hand-hold grips.

9. The amusement-thrill apparatus according to claims-7, wherein said one section bungee-cord member includes a proximally medially located acrobat holding means in the form of a conventional abdominal or pelvic safety-harness device capable of passively holding the acrobat fast to said bungee-cord without hand assistance.

10. The amusement-thrill apparatus according to claim-1, wherein said suspension-spring medium means is comprised of two cooperating linear sections each having one or more linearly clustered conventional bungee-cord elements; the interfacing ends of both said linear sections including a hand-hold means which the acrobatic person manually grips during acrobatics.

11. The amusement-thrill apparatus according to claim-1, wherein a resilient-platform is staged upon the ground within at least one of said four maneuvering-bays, thereby enabling the acrobat to enjoy further inertial impetus compelled by rebounding upon said resilient-platform, while also relying upon said resilient-platform as a soft-landing safety provision; said resilient-platform means thus being either a conventional trampoline-platform or is a conventional inflated airbag type of platform.

12. An amusement-thrill apparatus for aerially suspending multiple independent participants in three or more spatially segregated dynamic maneuvering-bays; said apparatus comprising:

a central vertical pylon providing a common intersection mooring means for a plurality of rigid tubular support-booms obliquely bisecting midway up said pylon, whereby each of said support-booms is thereby impinging upon the grounding-surface, at one end while extending up in the air at the opposite side of said pylon, and including a compression-beam extending between the lower region of each said support-boom and the opposite overhanging upper region of an bisecting oppposite said support-boom;

a cooperative plurality of tension-cables arranged by triangulating means and secured via mechanical attachment means proximal the upper distal end of said pylon and said support-booms, thereby creating a rigidly united free-standing structure of said obliquely angled support-booms;

a discrete arrangement of bungee-cords strung between the upper distal terminuses of said support-booms, thereby defining spatially distinct maneuvering-bays within which an acrobatic person can independently exercise bodily gyrations at will while suspended in the air mid-way between said support-booms;

a discrete arrangement of actuation pulley-line means for independently raising or lowering each said acrobatic person, whereby an ingressing person is attached by positive engagement means to said bungee-cord, whereupon shortening said pulley-line via winching means the acrobatic person becomes elevated to a height safely above the embarking surface, and conversely when said acrobatic person has completed their acrobatics, they are subsequently lowered back to the embarking surface for detaching and egressing from said maneuvering-bay area.

13. The amusement-thrill apparatus according to claim-12, wherein a set of two said diagionally intersecting opposing said support-booms define an X-shape when viewed from side/elevation-view and as a three-pointed Y-configuration as viewed from a upper/plan-view wherein said pylon appears as a central point of proximal convergence; said plural discrete bungee-cord members thereby aggregately appearing in upper/plan-view to form a delta-pattern strung across between said maneuvering-bays thereto.

14. The amusement-thrill apparatus according to claim-12, wherein there are two sets of two diagionally intersecting opposing said support-booms, each said set appearing to define an X-shape when viewed from side/elevation-view, and appearing in upper/plan-view to also form an X-configuration wherein said pylon appears as a central point of proximal convergence and said plural discrete bungee-cord members thereby aggregately appearing as a box-pattern strung across between adjoining said support-booms defining said maneuvering-bays thereto.

15. The amusement-thrill apparatus according to claim-12, wherein there are three sets of two diagionally intersecting opposing said support-booms, each said set appearing to define an X-shape when viewed from side/elevation-view, and appearing in upper/plan-view to form an six-pointed cross-configuration wherein said pylon appears as a central point of proximal convergence and said plural discrete bungee-cord members thereby aggregately appearing as a hexagonal-pattern strung across between adjoining said support-booms defining said maneuvering-bays thereto.

16. The amusement-thrill apparatus according to claim-12, wherein there are four sets of two diagionally intersecting opposing said support-booms, each said set appearing to define an X-shape when viewed from side/elevation-view, and appearing in upper/plan-view to form an eight-pointed cross-configuration wherein said pylon appears as a central point of proximal convergence and said plural discrete bungee-cord members thereby aggregately appearing as a octagonal-pattern strung across between adjoining said support-booms defining said maneuvering-bays thereto.

17. The amusement-thrill apparatus according to claim-12, herein said winching means is a motor-driven reversible-drive actuatable via a remote-control command-module carried upon the acrobatic person or by a ground-operator; thereby enabling them to at any time regulate the degree of tension applied to said pulley-line according to the acrobat's personal preference.

18. The amusement-thrill apparatus according to claim 12, wherein a resilient-platform means is staged upon the ground within at least one of said four maneuvering-bays, thereby enabling the acrobat to enjoy further inertial impetus compelled by rebounding upon said resilient-platform, while also relying upon said resilient-platform as a soft-landing safety provision.

19. The amusement-thrill apparatus according to claim 18, wherein the resilient-platform is a convention trampoline-platform.

20. The amusement-thrill apparatus according to claim 18, wherein the resilient platform is a conventional inflated air bag type of platform.

21. A four-bay amusement-thrill apparatus for aerially suspending four separate participants in spatially segregated maneuvers dynamically enhanced by resilient-platform interaction; said apparatus comprising:

a central vertical pylon providing a common intersection mooring means for a plurality of four rigid contiguous tubular support-booms obliquely bisecting midway up said pylon, whereby each of said support-booms is thereby impinging down upon the grounding-surface at the lower half leg portion of said support-boom while extending up in the air via its opposite upper half arm portion relative to said pylon, the resulting configuration thereby defining four spatially distinctmaneuvering-bays, wherein one or more of said maneuvering-bays includes a resilient-platform means arranged between said leg for both rebounding upon and as a soft-landing safety provision;

a dedicated plurality of compression-beams, one each extending approximately:;vertically between said lower leg portion of a said support-beam and upwardly to the overhanging said upper arm portion of a bisecting opposite said support-boom; thereby totaling four said compression, beams in aggregate contributing additional rigidity to the overall said structure;

a cooperative plurality of tension-cables arranged by triangulating means and secured via mechanical attachment means proximal the upper distal ends of said pylon and said support-booms, said triangulating means thereby creating a rigidly united free-standing structure of said obliquely angled support-booms;

a discrete arrangement of suspension-springing medium means strung between said upper arm distal terminuses of said support-booms across said spatially distinct maneuvering-bays within which an acrobatic persons can independently exercise bodily gyrations at will while suspended in the air from said tension-spring means proximally between any adjoining said support-booms.

22. The amusement-thrill apparatus according to claim 21, wherein said resilient-platform means is a conventional trampoline-platform.

23. The amusement-thrill apparatus according to claim 21, wherein said suspension-spring medium means are bungee-cords each secured to a separate pulley-line means moored from a guide-pulley secured proximally the outer-upper distal end of a given said support-boom arm portion, thereby enabling the addressing acrobatic person to be independently raised from the embarking-surface when said pulley-line is shortened and conversely lowered to said embarking-surface when said pulley-line is lengthened, in either event via advantage of a winch.

24. The amusement-thrill apparatus according to claim 23, wherein the winch is a manually-powered windlass racheted winch.

25. The amusement-thrill apparatus according to claim 23, wherein the winch is a motor-driven reversible-drive winch.

26. The amusement-thrill apparatus according to claim 21, wherein said resilient platform means is a conventional inflated air bag.

* * * * *